United States Patent [19]

Nagamori et al.

[11] Patent Number: 4,650,595

[45] Date of Patent: Mar. 17, 1987

[54] METAL WORKING WATER-SOLUBLE LUBRICANT COMPOSITION AND METHOD OF FEEDING SAME

[75] Inventors: Hiroyuki Nagamori; Takashi Mukai; Rikio Tsushima, all of Wakayama; Hiroshi Kuwamoto, Fukuyama; Shuichi Iwado, Fukuyama; Takeru Sharyo, Fukuyama, all of Japan

[73] Assignees: Kao Corporation; Nippon Kokan Kabushiki Kaisha, both of Tokyo, Japan

[21] Appl. No.: 547,678

[22] Filed: Nov. 1, 1983

[30] Foreign Application Priority Data

Nov. 11, 1982 [JP] Japan ..... 57-197930

[51] Int. Cl.[4] ..... C10M 107/14

[52] U.S. Cl. ..... 252/32.5; 252/34.7; 252/49.3

[58] Field of Search ..... 252/32.5, 34.7, 49.3

[56] References Cited

U.S. PATENT DOCUMENTS

| | | | |
|---|---|---|---|
| 2,999,064 | 9/1961 | Sluhan | 252/49.3 |
| 3,484,374 | 12/1969 | Cyba | 252/32.5 |
| 3,629,112 | 12/1971 | Gower et al. | 252/34.7 |
| 3,661,880 | 5/1972 | Markert et al. | 260/89.5 N |
| 3,945,930 | 3/1976 | Sugiyama et al. | 252/32.5 |
| 3,966,619 | 6/1976 | Smith et al. | 252/32.5 |
| 3,980,571 | 9/1976 | Marx | 252/49.3 |
| 4,085,054 | 4/1978 | Bussi et al. | 252/49.3 |
| 4,132,657 | 1/1979 | Verdicchio et al. | 252/32.5 |

FOREIGN PATENT DOCUMENTS

| | | | |
|---|---|---|---|
| 1364834 | 8/1974 | United Kingdom | 252/32.5 |
| 2017750 | 10/1979 | United Kingdom | 252/49.3 |

OTHER PUBLICATIONS

Kirk-Othmer, The *Encyclopedia of Chemical Technology*, 3rd. ed., vol. 17, Wiley Interscience Publication, (1982), p. 491.

*Encyclopedia of Polymer Science & Technology*, vol. 1, pp. 203 to 207.

*Primary Examiner*—Andrew H. Metz
*Assistant Examiner*—Margaret B. Medley
*Attorney, Agent, or Firm*—Oblon, Fisher, Spivak, McClelland & Maier

[57] ABSTRACT

A metal working water-soluble lubricant composition comprising a water-soluble polymer compound whose counter anion is acidic phosphorus-containing compound or boric acid is disclosed.

The water-soluble polymer compound is selected from the group consisting of cationic or amphoteric addition polymers, ring-opened polymers, polycondensation products and salts or quaternary ammonium salts of natural polymer derivatives having at least one basic or cationic nitrogen atom in one molecule thereof with a molecular weight of 1,000 to 10,000,000.

The composition has a load resistance equal to or higher than known liquid lubricants which contain mineral oils, beef tallow etc., and shows an excellent lubricating performance when applied to a metal working surface.

19 Claims, No Drawings

METAL WORKING WATER-SOLUBLE LUBRICANT COMPOSITION AND METHOD OF FEEDING SAME

BACKGROUND OF THE INVENTION (i) Field of the Invention

This invention relates to novel water-soluble lubricant compositions for use in metal working, and more particularly, to metal working water-soluble lubricant compositions useful as lubricants in metal working such as plastic working, machining and grinding, which comprise salts or quaternary ammonium salts of water-soluble cationic or amphoteric polymer compounds.

(ii) Description of the Prior Art

General and hitherto employed liquid lubricants in metal working such as plastic working, machining and grinding are formed into emulsions with predetermined concentrations of emulsifiers such as surfactants, and supplied to the surfaces of metal materials to be worked. Such liquid lubricants have a characteristic that they owe the lubricating performance to particles of liquid lubricants emulsified with surfactants etc., which is deposited on the surfaces of metal materials to be worked. Especially, liquid lubricants emulsified in water are advantageous in view of cooling effect on heat generated when metal materials are worked, and also from the economical standpoint of circulation-use of emulsions. On the other hand, they have the following drawbacks in dealing with the emulsions;

(1) Poor stability of emulsions, (2) Contamination of emulsions with contaminants such as metal powders and scums produced when metal materials are worked, (3) Contamination of the surfaces of metal materials to be worked with the above contaminants, (4) Reduced load resistance which is alternately introduced when the amount of lubricant particles on the surfaces of material to be worked is made reduced to obtain an enhanced stability of emulsion, (5) Waste water treatment of emulsions is difficult, and (6) Corrosion and rusting of materials to be worked caused mainly by water.

Accordingly, development of such water-soluble lubricants as to overcome the above drawbacks is strongly desired. In this connection, however, lubricants utilizing emulsifiers have as yet a number of difficulties to be solved and are not satisfactory.

SUMMARY OF THE INVENTION

In order to overcome the drawbacks of the known liquid lubricant and provide an improved water-soluble lubricant, an intensive study has been made and it was found that the above object can be achieved by using water solutions of compositions comprising salts or quaternary ammonium salts of specified types of water-soluble cationic or amphoteric polymer compounds (hereinafter merely called water-soluble polymer compound) without employing the liquid lubricants.

According to the present invention, there is provided a metal working water-soluble lubricant composition which comprises at least one water-soluble polymer compound whose counter anion is acidic phosphorus-containing compound or boric acid, and said water-soluble polymer compound being selected from the group consisting of cationic or amphoteric addition polymers, ring-opened polymers, polycondensation products and salts or quaternary ammonium salts of natural polymer derivatives having at least one basic nitrogen atom or cationic nitrogen atom in one molecule thereof with a molecular weight of 1,000 to 10,000,000; and a method of feeding same.

DETAILED DESCRIPTION OF THE INVENTION AND PREFERRED EMBODIMENTS

The water-soluble polymer compounds used in the metal working water-soluble lubricant compositions of the invention should essentially contain basic nitrogen atoms or cationic nitrogen atoms therein and may further contain in a molecule thereof the groups of carboxylates, sulfonates, amides, esters, etc. Examples of these polymer compounds are as follows.

(a) Homopolymers salts or quaternary ammonium salts of nitrogen-containing monomers represented by the following general formulas (I) to (V), or copolymers of two or more salts thereof:

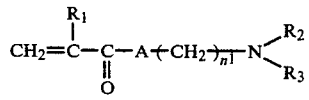

(I)

in which A represents —O— or —NH—, $n^1$ is an integer of 1 to 3, $R_1$ represents H or $CH_3$, and $R_2$ and $R_3$ independently represent H, $CH_3$ or $C_2H_5$;

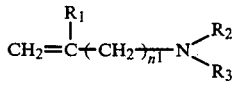

(II)

in which $R_1$, $R_2$, $R_3$ and $n^1$ have the same meanings as defined in the formula (I), respectively;

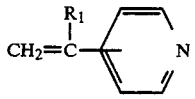

(III)

in which $R_1$ has the same meaning as defined in the formula (I), and the pyridine is substituted at the 2- or 4-position;

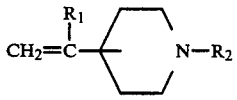

(IV)

in which $R_1$ and $R_2$ have the same meanings as defined in the formula (I), respectively, and the piperidine is substituted the at 2- or 4-position, and

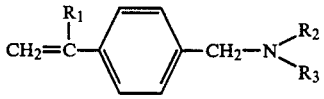

(V)

in which $R_1$, $R_2$ and $R_3$ have the same meanings as defined in the formula (I), respectively.

Examples of these monomers include: those represented by the formula (I) such as dimethylaminoethyl acrylate, diethylaminoethyl acrylate, dimethylaminoethyl methacrylate, diethylaminoethyl methacrylate, dimethylaminopropyl acrylamide, diethylaminopropyl acrylamide, dimethylaminopropyl methacrylamide, diethylaminopropyl methacrylamide and the like; those represented by the formula (II) such as dimethylaminomethylethylene, diethylaminomethylethylene, dimethylaminomethylpropene, diethylaminomethylpropene and the like; those represented by the formula (III) such as vinylpyridine and the like; those represented by the formula (IV) such as vinylpiperidine, vinyl-N-methylpiperidine and the like; and those of the formula (V) such as vinylbenzylamine, vinyl-N,N-dimethylbenzylamine and the like.

The homopolymers or copolymers of these monomers should have an average molecular weight of 1,000 to 10,000,000.

(b) Copolymers of one or more of the salts or quaternary ammonium salts of nitrogen-containing monomers of the general formula (I) through (V) and one or more vinyl monomers selected from the group consisting of $\alpha,\beta$-unsaturated carboxylic acids and, their salts or derivatives, sulfonic acid group-containing vinyl compounds and their salts, acrylonitrile, vinylpyrrolidone and aliphatic olefins having 2 to 20 carbon atoms.

Examples of the vinyl monomers include: vinylpyrrolidone and acrylonitrile; acrylic acid, methacrylic acid and maleic acid, and alkali metal salts, ammonium salts, amide compounds and ester compounds thereof; and vinylsulfonic acid, methallylsulfonic acid, 2-acrylamino-2-methylpropanesulfonic acid, p-styrenesulfonic acid and alkali metal salts and ammonium salts thereof. Among copolymers of the nitrogen-containing monomers and vinyl monomers, those having an average molecular weight of 1,000 to 10,000,000 are used.

(c) Salts and quaternary ammonium salts of ring-opened polymers of ethyleneimine.

These polymers having the recurring units represented by the general formula (VI) and an average molecular weight of 1,000 to 10,000,000.

$$\left[\left(CH_2CH_2-NH\right)_{n^2}\left(CH_2CH_2-\underset{\underset{CH_2CH_2NH_2}{|}}{N}\right)_{n^3}\right] \quad \text{(VI)}$$

in which $n^2$ is an integer of 1 to 5, and $n^3$ is an integer of 0 to 5.

(d) Salts or quaternary ammonium salts of polycondensation products of aliphatic dicarboxylic acids and polyethylenepolyamine or dipolyoxyethylenealkylamines.

Examples of these polymers include polycondensation products with polyethylenepolyamines having a recurring unit represented by the general formula (VII) and polycondensation products with dipolyoxyethylenealkylamines represented by the general formula (VIII), having a molecular weight of ranging 1,000 to 10,000,000.

$$\left[OC-R_4-CONH\left(R'-NH\right)_{n^4}R'-NH\right] \quad \text{(VII)}$$

in which $R_4$ represents a dimeric acid residue or an alkylene group having 1 to 10 carbon atoms, R' represents $-CH_2CH_2-$, and $n^4$ is an integer of 2 to 7, $$\left[OC-R_4-CO\left(OCH_2\overset{\overset{R_6}{|}}{C}H\right)_{n^5}\overset{\overset{R_5}{|}}{N}\left(\overset{\overset{R_6}{|}}{C}HCH_2O\right)_{n^6}\right] \quad \text{(VIII)}$$

in which $R_4$ has the same meaning as defined in the formula (VII), $R_5$ represents an alkyl group having 1 to 8 carbon atoms, $R_6$ represents H or $CH_3$, and $n^5$ and $n^6$ are independently an integer of 1 to 10.

The aliphatic dicarboxylic acids are dimeric acid, adipic acid and the like, and the polyethylenepolyamines are diethylenetriamine, triethylenetetramine and the like.

(e) Salts or quaternary ammonium salts of polycondensation products of dihaloalkane-polyalkylenepolyamines.

These products are polycondensation products of dihaloalkanes such as 1,2-dichloroethane, 1,2-dibromoethane, 1,3-dichloropropane and the like, and quaternary ammonium salts of polyalkylenepolyamines having two or more tertiary amino groups in the molecule thereof, whose average molecular weight is in the rage of 1,000 to 10,000,000.

Examples of the polyalkylenepolyamines include:

| | |
|---|---|
| $(CH_3)_2N-CH_2CH_2-N(CH_3)_2$ | (tetramethylethylenediamine) |
| $(CH_3)_2N-CH_2CH_2CH_2-N(CH_3)_2$ | (tetramethylpropylenediamine) |
| $(CH_3)_2N-CH_2CH_2N(CH_3)CH_2CH_2-N(CH_3)_2$ | (pentamethyldiethylenetriamine) |
| 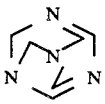 | (hexamethylenetetramine) |
| 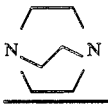 | (triethylenediamine) |

(f) Salts or quaternary ammonium salts of polycondensation products of epihalohydrin-amines.

These are mentioned those products having the recurring units of the following general formula (IX) and an average molecular weight of 1,000 to 10,000,000.

$$\left[O-CH_2\underset{\underset{R_7-\overset{\overset{R_8}{|}}{N^{\oplus}}-R_9X^{\ominus}}{|}}{\overset{\overset{CH_2}{|}}{C}}H\right] \quad \text{(IX)}$$

in which $R_7$–$R_9$ represent $CH_3$ or $C_2H_5$, and $X^-$ represents a halogen ion.

(g) Salts or quaternary ammonium salts of chitosan, and cationized products of starch or cellulose.

Additionally, examples of the counter ions of the water-soluble polymer compounds are boric acid, and acidic phosphorus containing compounds shown in the following (i) through (vii).

(i) Phosphoric acid, phosphorous acid or thio compounds thereof.

(ii) Monophosphate or diphosphate of organic hydroxy compound, or thio compounds thereof.

(iii)

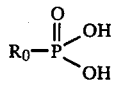

in which $R_0$ represents an alkyl group or an allyl group having 1 to 8 carbon atoms.

(vi)

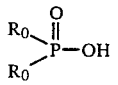

in which $R_0$ has the same meaning as defined in the formula (iii).

(v) Mono- or di-alkylthiophosphoric acid containing an alkyl group or an allyl group having 1 to 8 carbon atoms.

(vi)

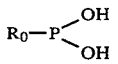

in which $R_0$ has the same meaning as defined in the formula (iii).

(vii)

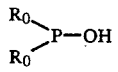

in which $R_0$ has the same meaning as defined in the formula (iii).

Although not completely known, the functions of the water-soluble polymer compounds according to the invention are considered as follows. By feeding water solutions containing the water-soluble polymer compounds to a work portion of a metal, the water-soluble polymer compounds form a tight adsorption film due to strong adsorption activity of the groups arising from the nitrogen atoms on the surface of the metal and, at the same time, counter ion acids forming salts or quaternary ammonium salts are adsorbed to form tighter adsorption films of the water-soluble polymer compounds.

The above-mentioned water-soluble polymer compounds can be used singly or in combination in the metal working water-soluble lubricant compositions of the invention. They can also be used in the form of water solutions by adding water to them. Aside from the components described above, the metal working water-soluble lubricant composition of the present invention may be admixed with other known various additives, if necessary, such as water-soluble antioxidants, water-soluble thickeners, water-soluble oiliness improvers, water-soluble rust inhibitors and the like, which may be added in amounts of 0 to 10% of the total of the metal working water-soluble lubricant composition, respectively.

The water-soluble rust inhibitors include, for example, inorganic compounds such as chromates, nitrites, molybdates, tungstates and polymerized phosphates, organic compounds such as (1) monoamines, diamines, amides or their ethoxyle compounds, monobasic acids, dibasic acids, naphthenates, phosphates and salts mentioned above as inorganic compounds, (2) alkali salts of amino acid, (3) imidazoline derivatives, (4) quaternary ammonium salts and (5) mercaptobenzotriasol, and the like.

The metal working water-soluble lubricant composition of the invention is diluted with water to a concentration ranging from 100 to 500,000 ppm (preferably 1,000 to 50,000 ppm).

The water solution of the metal working water-soluble lubricant composition of the invention is applied to a work portion of a metal by spraying or dipping. This water solution can be circulated and reused, since there is no decline in lubricativeness, etc. due to the contamination with scums and other contaminants.

Moreover, the thus obtained metal working water-soluble lubricant composition has the following advantages while holding a high cooling performance of lubricant in which water is used for emulsion:

(1) Excellent lubricating performance can be obtained when metal materials are worked, since it has a load resistance equal to or higher than the known liquid lubricants in the form of water solution, though it does not contain oily liquid lubricants such as mineral oils, beef tallow and beef tallow fatty acids.

(2) The worked surfaces of materials are clean, since it does not contain solid lubricants and oily liquid lubricants.

(3) The water-soluble polymer compounds have the function of rapidly absorbing metal powders and oil contaminants generated at the time of metal working, thereby rendering them hydrophilic to prevent them re-sticking, while since the water soluble polymer compounds do not have surface activity, no emulsification of the oil contaminants takes place, resulting in the realization of clean surfaces of materials to be worked and clean working environment.

(4) The composition involves little troubles in treating waste water, since it does not contain emulsifiers, etc. which are used in oily liquid lubricants.

(5) The composition is safe in view of the prevention of disasters, since it is used in the form of water solution.

Accordingly, the metal working water-soluble lubricant composition of the invention can be used effectively, for example, in the field of metal working such as plastic working, machining and grinding where the use of water is required for reasons of serious consideration of cooling, prevention of oil vapor, and the like. Moreover, it can be used even in the field of metal work involving heating or generation of heat, for which the known lubricants are generally used.

In addition, the metal working water-soluble lubricant composition of the invention have the function of absorbing metal powders and oil contaminants thereby rendering them hydrophilic so that no emulsification of them takes place to prevent re-sticking of the contaminants, showing the advantage that clean surfaces of materials to be worked and clean working environment can be realized.

The present invention is described by way of examples.

Water-soluble polymer compounds used in the metal working water-soluble lubricant compositions in the examples are shown in Table 1.

TABLE 1

| Symbol | Water-soluble polymer compound |
|---|---|
| A-1 | Polymer of phosphoric acid salt of diethylaminomethyl methacrylate (MW = 300,000) |
| A-2 | Polymer of phosphoric acid salt of diethylaminomethyl methacrylate (MW = 10,000) |
| A-3 | Polymer of phosphoric acid salt of diethylaminomethyl methacrylate (MW = 2,000) |
| B-1 | Copolymer of boric acid salt of diethylaminoethyl methacrylate/vinylpyrrolidone/sodium acrylate (5/4/1; MW = 200,000) |
| B-2 | Copolymer of boric acid salt of diethylaminoethyl methacrylate/vinylpyrrolidone/sodium acrylate (MW = 50,000) |
| B-3 | Copolymer of boric acid salt of diethylaminoethyl methacrylate/vinylpyrrolidone/sodium acrylate (MW = 5,000) |
| B-4 | Copolymer of boric acid salt of diethylaminoethyl methacrylate/vinylpyrrolidone/sodium acrylate (MW = 1,500) |
| B-5 | Copolymer of boric acid salt of diethylaminoethyl methacrylate/vinylpyrrolidone/sodium acrylate (MW = 700) |
| C-1 | Copolymer of phosphoric acid salt of diethylaminoethyl methacrylate/sodium methacrylate (4/5; MW = 20,000) |
| C-2 | Copolymer of phosphoric acid salt of diethylaminoethyl methacrylate/sodium methacrylate (MW = 8,000) |
| C-3 | Copolymer of phosphoric acid salt of diethylaminoethyl methacrylate/sodium methacrylate (MW = 1,000) |
| D | Ring-opened polymer of phosphoric acid salt of ethyleneimine (MW = 100,000) |
| E | Copolymer of ethyl phosphorous acid salt of dimethylaminoethyl methacrylate/sodium acrylate (3/1; MW = 300,000) |
| F | Copolymer of ethyl phosphonic acid salt of dimethylaminoethyl methacrylate/sodium 2-acrylamino-2-methylpropanesulfonate (4/1; MW = 100,000) |
| G | Copolymer of phosphoric acid salt of vinylpyridine/vinylpyrrolidone/sodium acrylate (6/3/1; MW = 450,000) |
| H | Polycondensation product of thiophosphoric acid salt of diethylenetriamine and dimeric acid (MW = 800,000) |
| I | Copolymer of phosphoric acid salt of diethylaminoethyl methacrylamide/sodium acrylate/sodium vinylsulfonate (3/1/1; MW = 400,000) |
| J | Copolymer of quaternary ammonium salt of vinylpyridine by dimethylphosphinic acid/vinylpyrrolidone/sodium acrylate (6/3/1; MW = 450,000) |
| K | Polymer of boric acid salt instead of phosphoric acid salt of diethylaminoethyl methacrylamide of water-soluble polymer compound (I) |
| L | Quaternary ammonium salt of cationized product of cellulose (MW = 1,000,000) |
| M | Polycondensation product of 1,2-dichloroethane and phosphate of hexamethylenetetramine (MW = 50,000) |
| N | Polycondensation product of diethyl phosphinic acid salt of diethylenetriamine and dimeric acid (MW = 800,000) |
| O | Ring-opened polymer of phosphorous acid salt of epichlorohydrin quaternized with trimethylamine (MW = 100,000) |
| P | Polycondensation product of quaternary ammonium salt of tetramethylpropylenediamine by diethylphosphonic acid (MW = 100,000) |
| Q | Polymer of sulfuric acid salt instead of phosphoric acid salt of water-soluble polymer compound (G) |
| R | Polymer of nitric acid salt instead of thiophosphoric acid salt of water-soluble polymer compound (H) |
| S | Polymer of hydrochloric acid salt instead of ethyl phosphonic acid salt of water-soluble polymer compound (F) |
| T | Polymer of glycotic acid salt instead of diethyl phosphinic acid salt of water-soluble polymer compound (E) |
| U | Polymer of acetic acid salt instead of phosphoric acid salt of water-soluble polymer compound (D) |
| V | Copolymer of quaternary ammonium salt of vinylpyridine by dimethyl sulfuric acid/vinylpyrrolidone/sodium acrylate (6/3/1; MW = 450,000) |

EXAMPLE 1

Seizure-proof Loading Test (Falex Test)

Seizure-proof loading tests were carried out using the water-soluble polymeric compounds shown in Table 1. Seizure-proof loads were measured for the metal working water-soluble lubricant compositions of the invention (inventive composition Nos. 1 through 37), lubricant compositions without the scope of the invention (comparative composition Nos. 1 through 11), and known emulsified (comparative composition Nos. 12 through 14) and soluble (comparative composition Nos. 15 and 16) lubricants shown in Table 2.

In Table 2, "water-soluble rust inhibitor" describes a lower amine salt of lauric acid. "Emulsifier" is polyoxyethylene alkylphenyl ether (HLB=10.8). "Antioxidant" is 2,4-di-t-butyl.p-cresol. "Anionic surfactant" describes a sodium salt of laurylsulphate. "α" means that 1,000 ppm of polyoxyethylene-monooleate (MW=9,000) is added as a thickener.

The seizure-proof load was measured according to a procedure prescribed in the compressive loading test (Falex test) of the ASTM standard D-3233. A sample to be tested was prepared by diluting each of the metal working water-soluble lubricant compositions, etc. with water to a predetermined concentration and agitating the dilution in a homogenizer at revolutions of 10,000 r.p.m. The sample solution was applied to a rotary pin at the center of a fixed block using a gear pump under conditions of spraying amount of 50 ml/minute (pressure: 0.5 kg/cm$^2$) and a dispersion temperature of 50° C.

The results are as shown in Table 2.

In Table 2, water-soluble polymeric compounds are merely shown as "polymeric compound".

TABLE 2

| No. | Metal Processing Water-soluble Lubricant Composition (Water Solution) | Seizure-proof Load (Pounds) |
|---|---|---|
| Inventive Composition No. 1 | Polymer (F) 500 ppm + Water-soluble 1000 ppm compound rust inhibitor | 1500 |
| Inventive Composition No. 2 | Polymer (F) 1000 ppm + Water-soluble 1000 ppm compound rust inhibitor | 1750 |
| Inventive Composition No. 3 | Polymer (F) 10000 ppm + Water-soluble 1000 ppm compound rust inhibitor | 2000 |
| Inventive | Polymer (G) 100 ppm + Water-soluble 1000 ppm | 1500 |

TABLE 2-continued

| No. | Metal Processing Water-soluble Lubricant Composition (Water Solution) | Seizure-proof Load (Pounds) |
|---|---|---|
| Composition No. 4 | compound rust inhibitor | |
| Inventive Composition No. 5 | Polymer (G) 1000 ppm + Water-soluble 1000 ppm compound rust inhibitor | 2000 |
| Inventive Composition No. 6 | Polymer (G) 10000 ppm + Water-soluble 1000 ppm compound rust inhibitor | 2000 |
| Inventive Composition No. 7 | Polymer (G) 20000 ppm + Water-soluble 1000 ppm compound rust inhibitor | 2000 |
| Inventive Composition No. 8 | Polymer (H) 5000 ppm + Water-soluble 1000 ppm compound rust inhibitor | 2000 |
| Inventive Composition No. 9 | Polymer (H) 10000 ppm + Water-soluble 1000 ppm compound rust inhibitor | 2250 |
| Inventive Composition No. 10 | Polymer (H) 50000 ppm + Water-soluble 1000 ppm compound rust inhibitor | 2500 |
| Inventive Composition No. 11 | Polymer (H) 100000 ppm + Water-soluble 1000 ppm compound rust inhibitor | 2500 |
| Inventive Composition No. 12 | Polymer (D) 250 ppm + Polymer (E) 250 ppm + Water-soluble 1000 ppm compound compound rust inhibitor | 1500 |
| Inventive Composition No. 13 | Polymer (J) 200 ppm + Polymer (K) 100 ppm + Water-soluble 1000 ppm compound compound rust inhibitor | 1750 |
| Inventive Composition No. 14 | Polymer (J) 1000 ppm + Polymer (K) 1000 ppm + Water-soluble 1000 ppm compound compound rust inhibitor | 2000 |
| Inventive Composition No. 15 | Polymer (J) 5000 ppm + Polymer (K) 5000 ppm + Water-soluble 1000 ppm compound compound rust inhibitor | 2000 |
| Inventive Composition No. 16 | Polymer (A-1) 10000 ppm + Water-soluble 1000 ppm compound rust inhibitor | 2250 |
| Inventive Composition No. 17 | Polymer (A-2) 10000 ppm + Water-soluble 1000 ppm compound rust inhibitor | 2250 |
| Inventive Composition No. 18 | Polymer (A-3) 10000 ppm + Water-soluble 1000 ppm + α compound rust inhibitor | 1500 |
| Inventive Composition No. 19 | Polymer (B-1) 10000 ppm + Water-soluble 1000 ppm compound rust inhibitor | 2000 |
| Inventive Composition No. 20 | Polymer (B-2) 10000 ppm + Water-soluble 1000 ppm compound rust inhibitor | 2000 |
| Inventive Composition No. 21 | Polymer (B-3) 10000 ppm + Water-soluble 1000 ppm compound rust inhibitor | 2000 |
| Inventive Composition No. 22 | Polymer (B-4) 10000 ppm + Water-soluble 1000 ppm + α compound rust inhibitor | 1750 |
| Inventive Composition No. 23 | Polymer (C-1) 10000 ppm + Water-soluble 1000 ppm compound rust inhibitor | 2250 |
| Inventive Composition No. 24 | Polymer (C-2) 10000 ppm + Water-soluble 1000 ppm compound rust inhibitor | 2000 |
| Inventive Composition No. 25 | Polymer (C-3) 10000 ppm + Water-soluble 1000 ppm + α compound rust inhibitor | 1500 |
| Inventive Composition No. 26 | Polymer (I) 5000 ppm + Water-soluble 1000 ppm compound rust inhibitor | 2000 |
| Inventive Composition No. 27 | Polymer (L) 5000 ppm + Water-soluble 1000 ppm compound rust inhibitor | 2000 |
| Inventive Composition No. 28 | Polymer (M) 5000 ppm + Water-soluble 1000 ppm compound rust inhibitor | 2250 |
| Inventive Composition No. 29 | Polymer (N) 5000 ppm + Water-soluble 1000 ppm compound rust inhibitor | 2000 |
| Inventive Composition No. 30 | Polymer (O) 5000 ppm + Water-soluble 1000 ppm compound rust inhibitor | 2250 |
| Inventive Composition No. 31 | Polymer (P) 5000 ppm + Water-soluble 1000 ppm compound rust inhibitor | 2000 |
| Inventive Composition No. 32 | Polymer (P) 100000 ppm + Water-soluble 1000 ppm compound rust inhibitor | 2000 |
| Comparative Composition No. 1 | Polymer (Q) 10000 ppm + Water-soluble 1000 ppm compound rust inhibitor | 300 |
| Comparative Composition No. 2 | Polymer (R) 20000 ppm + Water-soluble 1000 ppm compound rust inhibitor | <300 |
| Comparative Composition No. 3 | Polymer (S) 50000 ppm + Water-soluble 1000 ppm compound rust inhibitor | 300 |
| Comparative Composition No. 4 | Polymer (T) 10000 ppm + Water-soluble 1000 ppm compound rust inhibitor | 500 |
| Comparative Composition No. 5 | Polymer (U) 10000 ppm + Water-soluble 1000 ppm compound rust inhibitor | 750 |
| Comparative Composition No. 6 | Polymer (V) 10000 ppm + Water-soluble 1000 ppm compound rust inhibitor | 300 |
| Comparative Composition No. 7 | Polymer (F) 50 ppm + Water-soluble 1000 ppm compound rust inhibitor | 500 |
| Comparative Composition No. 8 | Polymer (H) 50 ppm + Water-soluble 1000 ppm compound rust inhibitor | 500 |
| Comparative Composition No. 9 | Polymer (D) 50 ppm + Polymer (E) 50 ppm + Water-soluble 1000 ppm compound compound rust inhibitor | 1000 |
| Comparative Composition No. 10 | Polymer (J) 50 ppm + Polymer (K) 100 ppm + Water-soluble 1000 ppm compound compound rust inhibitor | 1250 |
| Comparative Composition No. 11 | Polymer (B-5) 1000 ppm + Water-soluble 1000 ppm + α compound rust inhibitor inhibitor | 1000 |

TABLE 2-continued

| No. | Metal Processing Water-soluble Lubricant Composition (Water Solution) | Seizure-proof Load (Pounds) |
|---|---|---|
| Comparative Composition No. 12 | Composition of beef tallow/beef tallow fatty acid/emulsifier/antioxidant (90/5/4/1 by weight) (5% emulsion) | 1500 |
| Comparative Composition No. 13 | Composition of mineral oil/oleic acid/phosphoric ester extreme pressure additive/ triethanolamine/emulsifier/antioxidant (85.5/5/2/2/5/0.5 by weight) (3% emulsion) | 1250 |
| Comparative Composition No. 14 | The same composition as that of the comparative composition No. 13 (10% emulsion) | 1500 |
| Comparative Composition No. 15 | Composition of mineral oil/chlorinated paraffin/alkenylsuccinic acid triethanolamine/ polyhydric alcohol deri-ative/rust inhibitor/alkylsulfonylaminoacetic acid/anionic surfactant (25/30/5/5/5/25/5 by weight) (3% emulsion) | 750 |
| Comparative Composition No. 16 | The same composition as that of the comparative composition No. 15 (10% emulsion) | 1000 |
| Comparative Composition No. 17 | Water-soluble rust inhibitor 1,000 ppm | <300 |

We shall now evaluate the lubricating performance of the inventive composition Nos. 1 through 32 and the comparative composition Nos. 1 through 17 according to the results shown in Table 2.

As will be apparent from a comparison of the seizure-proof load resistance of the inventive composition Nos. 1 through 6, the compositions comprising salts or quaternary ammonium salts of boric acid, phosphoric acid or the like showed excellent seizure-proof load resistance when they were used in the form of water solutions ranging in concentration from 100 to 100,000 ppm, while the seizure-proof load resistance was poor in the compositions comprising salts or quaternary ammonium salts of sulfuric acid, nitric acid, glycolic acid, dimethylsulfuric acid or the like. Additionally, the compositions of the invention showed more excellent lubricating performance than the general and hitherto employed lubricants comprising lubricant components such as fats and oils or mineral oils formed into emulsions using emulsifiers (see comparative composition Nos. 12 through 16).

We investigated a correlation between the water solution concentration and seizure-proof load resistance of a water-soluble polymer compound using the inventive composition Nos. 1 through 15 and comparative composition Nos. 7 through 10.

As a result, it was proved that the seizure-proof load resistance is poor when the water solution concentration of a water-soluble polymer compound is 50 ppm and concentrations above 100 ppm (preferably above 1,000 ppm) are required to obtain satisfactory lubricating performance. However, there is not very much change in seizure-proof load resistance with the change of water solution concentration of a water-soluble polymer compound at concentrations above 50,000 ppm. Therefore, the water solution concentration is advantageously in the range of 1,000 to 50,000 ppm in due consideration of practicability.

We investigated the effect of the molecular weight of a water-soluble polymer compound on the load resistance using the inventive composition Nos. 16 through 25 and comparative composition No. 11. As a result, it was proved that the load resistance tends to be poorer with decreasing molecular weight of a water-soluble polymer compound and satisfactory load resistance can not be obtained even at a relatively high water solution concentration of 1,000 ppm when the water-soluble polymer compound has a molecular weight of 700. Therefore, it is to be understood that water-soluble polymer compounds should preferably have a molecular weight of above 1,000 to obtain excellent load resistance. However, the water-soluble polymer compounds increase their viscosities or solidify and their solubilities into water are decreased when they have a molecular weight of above 10,000,000.

In the inventive composition Nos. 18, 22 and 25 and the comparative composition No. 11, the viscosities of the water-soluble polymer compounds contained therein are low since they have a low molecular weight. Therefore, the thickener represented by $\alpha$ was added in order to evaluate the lubricating performance under conditions where viscosities are closer to a constancy.

A lower amine salt of lauric acid was mixed as a water-soluble rust inhibitor in all of the inventive composition Nos. 1 through 32 and the comparative composition Nos. 1 through 11. However, as shown in the comparative composition No. 17, the water-soluble rust inhibitor itself does not have a load resistance.

As will be apparent from the aforementioned results, the water-soluble polymer compounds of the invention showed excellent load resistance as components of lubricants by containing an acidic phosphoric group or boric acid as a counter anion. However, the comparative composition Nos. 1 through 6 were poor in load resistance, since they had inorganic acids such as hydrochloric acid and nitric acid or organic acids such as glycolic acid and acetic acid as the counter anions.

EXAMPLE 2

Waste Water Treating Test 3 g of aluminum sulfate was added to 1 l of sample solution prepared in the same way as in Example 1. The mixture solution was stirred for 2 minutes, then adjusted to pH 7.0 by the addition of $Ca(OH)_2$, and the resulting solution was stirred for 10 minutes. After standing for 30 minutes, the bottom liquid was collected and its COD was measured by the $KMnO_4$ method.

The results are as shown in Table 3.

TABLE 3

| No. | Metal Processing Water-soluble Lubricant Composition (Water Solution) | COD (ppm) ($KMnO_4$ method) |
|---|---|---|
| Inventive Composition No. 33 | Polymer (A-1) 30000 ppm + Water-soluble 1000 ppm compound rust inhibitor | 263 |
| Inventive Composition No. 34 | Polymer (A-2) 30000 ppm + Water-soluble 1000 ppm compound rust inhibitor | 281 |
| Inventive | Polymer (A-3) 30000 ppm + Water-soluble 1000 ppm | 222 |

TABLE 3-continued

| No. | Metal Processing Water-soluble Lubricant Composition (Water Solution) | COD (ppm) ($KMnO_4$ method) |
|---|---|---|
| Composition No. 35 | compound rust inhibitor | |
| Inventive Composition No. 36 | Polymer (B-1) 30000 ppm + Water-soluble compound 1000 ppm rust inhibitor | 255 |
| Inventive Composition No. 37 | Polymer (B-2) 30000 ppm + Water-soluble compound 1000 ppm rust inhibitor | 305 |
| Inventive Composition No. 38 | Polymer (B-3) 30000 ppm + Water-soluble compound 1000 ppm rust inhibitor | 365 |
| Inventive Composition No. 39 | Polymer (B-4) 30000 ppm + Water-soluble compound 1000 ppm rust inhibitor | 265 |
| Inventive Composition No. 40 | Polymer (C-1) 30000 ppm + Water-soluble compound 1000 ppm rust inhibitor | 221 |
| Inventive Composition No. 41 | Polymer (C-2) 30000 ppm + Water-soluble compound 1000 ppm rust inhibitor | 255 |
| Inventive Composition No. 42 | Polymer (C-3) 30000 ppm + Water-soluble compound 1000 ppm rust inhibitor | 270 |
| Inventive Composition No. 43 | Polymer (D) 30000 ppm + Water-soluble compound 1000 ppm rust inhibitor | 201 |
| Inventive Composition No. 44 | Polymer (E) 30000 ppm + Water-soluble compound 1000 ppm rust inhibitor | 263 |
| Inventive Composition No. 45 | Polymer (F) 30000 ppm + Water-soluble compound 1000 ppm rust inhibitor | 292 |
| Inventive Composition No. 46 | Polymer (G) 30000 ppm + Water-soluble compound 1000 ppm rust inhibitor | 316 |
| Inventive Composition No. 47 | Polymer (D) 15000 ppm + Polymer (E) 15000 ppm + Water-soluble compound compound 1000 ppm rust inhibitor | 329 |
| Inventive Composition No. 48 | Polymer (F) 15000 ppm + Polymer (G) 15000 ppm + Water-soluble compound compound 1000 ppm rust inhibitor | 278 |
| Inventive Composition No. 49 | Polymer (H) 30000 ppm + Water-soluble compound 1000 ppm rust inhibitor | 365 |
| Inventive Composition No. 50 | Polymer (I) 30000 ppm + Water-soluble compound 1000 ppm rust inhibitor | 351 |
| Inventive Composition No. 51 | Polymer (J) 30000 ppm + Water-soluble compound 1000 ppm rust inhibitor | 260 |
| Inventive Composition No. 52 | Polymer (K) 30000 ppm + Water-soluble compound 1000 ppm rust inhibitor | 358 |
| Inventive Composition No. 53 | Polymer (L) 30000 ppm + Water-soluble compound 1000 ppm rust inhibitor | 980 |
| Inventive Composition No. 54 | Polymer (M) 30000 ppm + Water-soluble compound 1000 ppm rust inhibitor | 850 |
| Inventive Composition No. 55 | Polymer (N) 30000 ppm + Water-soluble compound 1000 ppm rust inhibitor | 790 |
| Inventive Composition No. 56 | Polymer (O) 30000 ppm + Water-soluble compound 1000 ppm rust inhibitor | 890 |
| Inventive Composition No. 57 | Polymer (P) 30000 ppm + Water-soluble compound 1000 ppm rust inhibitor | 963 |
| Comparative Composition No. 18 | The same composition as that of the comparative composition No. 12 on Table 2 (3% emuslion) | 1750 |
| Comparative Composition No. 19 | The same composition as that of the comparative composition No. 13 on Table 2 (3% emuslion) | 2100 |
| Comparative Composition No. 20 | The same composition as that of the comparative composition No. 15 on Table 2 (3% emulsion) | 2800 |
| Comparative Composition No. 21 | The same composition as that of the comparative composition No. 17 on Table 2 (3% emulsion) | 103 |

As will be apparent from Table 3, the compositions of the invention involve less troubles in treating waste water than the known emulsion type (comparative composition Nos. 18 and 19) and solution type (comparative composition No. 20) metal working oils. Among the compositions of the invention, the composition Nos. 33 through 52 show especially excellent performance.

What is claimed is:

1. A metal working water-soluble lubricant composition comprising at least one water-soluble polymer compound whose counter ion is an acidic phosphorous-containing compound or boric acid, the said water-soluble polymer compound being selected from the group consisting of:

(a) homopolymers of salts of nitrogen-containing monomers represented by the formula (I), or copolymers of two or more salts thereof:

$$CH_2{=}C(R_1)—CO—A—(CH_2)_{n1}—NR_2R_3 \quad (I)$$

wherein A is —O— or —NH—, and $n^1$ is an integer of 1 to 3, $R_1$ is H or $CH_3$, and $R_2$ and $R_3$ are each independently H, $CH_3$ or $C_2H_5$; and (c) salts of ring-opened polymers of ethyleneemine, with a molecular weight of 10,000 to 10,000,000.

2. The metal working water-soluble lubricant composition of claim 1, wherein the acidic phosphor-containing compound which acts as a counter ion is a member selected from:

(i) phosphoric acid, phosphorous acid or thio compounds thereof, (ii) mono- or di-phosphates of organic hydroxy compounds, or thio compounds thereof, (iii) $R_o$—$P(O)(OH)_2$, in which $R_o$ represents an alkyl group or an allyl group having 1 to 8 carbon atoms, (iv) $(Ro)_2P(O)OH$ in which $R_o$ has the same meaning as defined in (iii), (v) mono- or di-alkyl thiophosphonic acid containing an alkyl group or an allyl group having 1 to 8 carbon atoms, (vi) $R_o—P(OH)_2$ in which $R_o$ has the same meaning as defined in (iii) and (vii) $(R_o)_2POH$ in which $R_o$ has the same meaning as defined in (iii).

3. The metal working water-soluble lubricant composition of claim 1, wherein the molecular weight of the water-soluble polymer compound range is from 10,000 to 1,000,000.

4. The metal working water-soluble lubricant composition of claim 1, wherein the recurring units of the ring-open polymer of ethyleneimine are represented by the following general formula (VI)

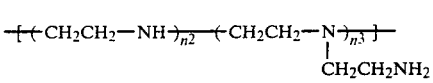

(VI)

in which $n^2$ is an integer of 1 to 5, and $n^3$ is an integer of 0 to 5.

5. The metal working water-soluble lubricant composition of claim 1, wherein the said group (a) homopolymer is a quaternary salt of a nitrogen-containing monomer represented by the general formula (I).

6. The metal working water-soluble lubricant composition of claim 1, wherein the said group (c) is a quaternary ammonium salt.

7. A metal working water-soluble lubricant composition comprising at least one water-soluble polymer compound whose counter ion is an acidic phosphorous-containing compound or boric acid, the said water-soluble polymer compound being selected from the group consisting of:

(a) homopolymers of salts of nitrogen-containing monomers represented by the formula (I), or copolymers of two or more salts thereof:

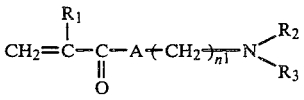

(I)

wherein A is —O— or NH—, $n^1$ is an integer of 1 to 3, $R_1$ is H or $CH_3$, and $R_2$ and $R_3$ are each independently H, $CH_3$ or $C_2H_5$;

(b) copolymers of at least one of the salts of a nitrogen-containing monomer represented by formula (I), and at least one vinyl monomer selected from the group consisting of $\alpha,\beta$-unsaturated carboxylic acids, their salts and derivatives, sulfonic acid group-containing vinyl compounds and their salts, acrylonitrile, vinyl pyrrolidone and aliphatic olefins having 2 to 20 carbon atoms; and (c) salts of ring-opened polymers of ethyleneimine, with a molecular weight of 10,000 to 10,000,000.

8. A metal working water-soluble lubricant composition according to claim 7, wherein the acidic phosphorus-containing compound which acts as a counter anion is a member selected from the following groups of (i) to (vii):

(i) phosphoric acid, phosphorous acid or thio compounds thereof, (ii) mono- or di-phosphates of organic hydroxy compounds, or thio compounds thereof, (iii)

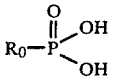

in which $R_0$ represents an alkyl group or an allyl group having 1 to 8 carbon atoms, (iv)

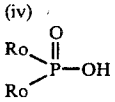

in which $R_0$ has the same meaning as defined in the formula (iii), (v) mono- or di-alkylthiophosphonic acid containing an alkyl group or an allyl group having 1 to 8 carbon atoms, (vi)

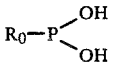

in which $R_0$ has the same meaning as defined in the formula (III), and (vii)

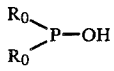

in which $R_0$ has the same meaning as defined in the formula (iii).

9. A metal working water-soluble lubricant composition according to claim 7, wherein the molecular weight of the water-soluble polymer compound ranges from 10,000 to 1,000,000.

10. A metal working water-soluble lubricant composition according to claim 7, wherein the $\alpha,\beta$-unsaturated carboxylic acid to be copolymerized with the nitrogen-containing monomer is acrylic acid, methacrylic acid or maleic acid, its salt is an alkali metal or ammonium salt, and its derivative is an alkylamide, alkyl ester or acrylonitrile.

11. A metal working water-soluble lubricant composition according to claim 7, wherein the sulfonic acid group-containing vinyl compound to be copolymerized with the nitrogen-containing monomer is vinylsulfonic acid, allylsulfonic acid, methallylsulfonic acid, 2-acrylamino-2-methylpropanesulfonic acid or p-styrenesulfonic acid, and its salt is an alkali metal or ammonium salt.

12. A metal working water-soluble lubricant composition according to claim 7, wherein the recurring units of the ring-opened polymer of ethyleneimine are represented by the following general formula (VI)

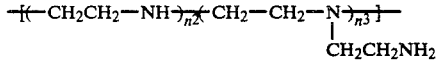

(VI)

in which $n^2$ is an integer of 1 to 5, and $n^3$ is an integer or 0 to 5.

13. The metal working water-soluble lubricant of claim 7 wherein said water-soluble polymer compound is a quaternary ammonium salt of a natural polymer derivative having at least one basic or cationic nitrogen atom per molecule thereof and a molecular weight of 1,000 to 10,000,000.

14. The metal working water-soluble lubricant of claim 7 wherein said group (a) homopolymer is a quaternary ammonium salt of a nitrogen-containing monomer represented by the general formula (I) (V).

15. The metal working water-soluble lubricant of claim 7 wherein said group (b) copolymer is at least one quaternary ammonium salt of a nitrogen-containing monomer represented by the general formula (I).

16. The metal working water-soluble lubricant of claim 7 wherein said group (c) is a quaternary ammonium salt.

17. A method of feeding a metal working water-soluble lubricant composition comprising;

(i) preparing a water solution of a metal working water-soluble lubricant composition by dilution with water in use;

(ii) feeding the water solution to the work portion of a metal by spraying or dipping; said metal working water-soluble lubricant comprising at least one water-soluble polymer compound whose counter anion is an acidic phosphorous-containing compound or boric acid, the said water-soluble polymer compound being selected from the group consisting of (a) homopolymers of salts of nitrogen containing monomers represented by the formula (I), or copolymers of two or more salts thereof:

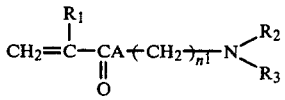

(I)

wherein A is —O— or NH—, $n^1$ is an integer of 1 to 3, $R_1$ is H or $CH_3$, and $R_2$ and $R_3$ are each independently H, $CH_3$ or $C_2H_5$;

(b) copolymers of at least one of the salts of a nitrogen-containing monomer represented by formula (I), and at least one vinyl monomer selected from the group consisting of $\alpha,\beta$-unsaturated carboxylic acids, their salts and derivatives, sulfonic acid group-containing vinyl compounds and their salts, acrylonitrile, vinyl pyrrolidone and aliphatic olefins having 2 to 20 carbon atoms; and (c) salts of ring-opened polymers of ethyleneimine, with a molecular weight of 10,000 to 10,000,000.

18. A method of feeding the metal working water-soluble lubricant composition characterized by comprising; preparing a water solution of a metal working water-soluble lubricant composition by dilution with water in use; feeding the water solution to a work portion of a metal by spraying or dipping; said metal working water-soluble lubricant comprising at least one water-soluble polymer compound whose counter anion is acidic phosphorus-containing compound or boric acid, and said water-soluble polymer compound being selected from the group consisting of cationic or amphoteric addition polymers, ring-opened polymers, polycondensation products and salts of natural polymer derivatives having at least one basic nitrogen atom or cationic nitrogen atom in one molecule thereof with a molecular weight of 1,000 to 10,000,000.

19. A method of feeding the metal working water-soluble lubricant composition according to claim 18, wherein concentration of the water-soluble polymer compound in a water solution thereof ranges from 100 to 500,000 ppm.

* * * * *